US008082648B2

(12) United States Patent
Kozasa et al.

(10) Patent No.: US 8,082,648 B2
(45) Date of Patent: Dec. 27, 2011

(54) PANEL INTEGRATING METHOD

(75) Inventors: Nobuhiro Kozasa, Tochigi (JP); Takafumi Ikeda, Tochigi (JP); Michio Kamiyama, Tochigi (JP); Hitoshi Yoshimichi, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 421 days.

(21) Appl. No.: 12/454,285

(22) Filed: May 15, 2009

(65) Prior Publication Data

US 2009/0288284 A1 Nov. 26, 2009

(30) Foreign Application Priority Data

May 22, 2008 (JP) ..... 2008-133832

(51) Int. Cl.
*B21D 39/02* (2006.01)
*B23P 19/00* (2006.01)

(52) U.S. Cl. ..... 29/505; 29/509; 29/243.5; 29/243.58; 403/282

(58) Field of Classification Search ..... 29/505, 29/509, 521, 243.5, 243.58; 72/220; 403/282
See application file for complete search history.

(56) References Cited

U.S. PATENT DOCUMENTS 2,576,657 A * 11/1951 Walters ..... 52/482
5,224,253 A * 7/1993 Sawa ..... 29/243.58
5,611,133 A * 3/1997 Toeniskoetter ..... 29/509
5,752,304 A * 5/1998 Toeniskoetter ..... 29/243.58
6,052,887 A * 4/2000 Dziadosz et al. ..... 29/509
6,477,879 B1 * 11/2002 Sawa ..... 72/220
6,739,168 B2 * 5/2004 Hario et al. ..... 72/306
6,820,449 B2 * 11/2004 Seifert et al. ..... 72/57
7,607,331 B2 * 10/2009 Carsley et al. ..... 72/306
2005/0229376 A1 * 10/2005 Herman ..... 29/509

FOREIGN PATENT DOCUMENTS

JP 2000-343156 12/2000

* cited by examiner

*Primary Examiner* — Jermie Cozart
(74) *Attorney, Agent, or Firm* — Carrier Blackman & Associates, P.C.; Joseph P. Carrier; William D. Blackman

(57) ABSTRACT

An outer panel and an inner panel are integrated by placing peripheral parts of the outer panel on a top surface of a lower mold such that bending parts formed by bending the peripheral parts of the outer panel are set up upward; placing a central portion of the outer panel on a top surface of a lifting device; lifting the central portion of the outer panel by the lifting device to open leading end sides of the bending parts of the outer panel outward; placing the inner panel on the top surface of the outer panel so as to superimpose those onto each other; lowering the central portion of the outer panel by the lifting device; and pressing the bending parts toward the lower mold by an upper mold to further bend the bending parts, and making the bending parts to closely contact with the peripheral parts of the inner panel.

1 Claim, 2 Drawing Sheets

PANEL INTEGRATING METHOD

BACKGROUND OF THE INVENTION

1. Field of the Invention

The present invention relates to a panel integrating method. Particularly, the present invention relates to a panel integrating method for integrating an outer panel and an inner panel.

2. Background Art

Conventionally, an automobile door panel is configured by integrating an outer panel forming an outer side of the door panel and an inner panel forming an inner side of the door panel. This door panel is manufactured through a marriage process of superimposing the outer panel and the inner panel onto each other and a hemming process in which the outer panel and the inner panel superimposed in the marriage process are integrated (refer to JP-A-2000-343156).

In the marriage process, peripheral parts of the outer panel are bent upward to form bending parts, and the inner panel is superimposed on the outer panel.

Next, a carrier device places the superimposed outer panel and inner panel on a lower mold of a hemming apparatus and a top surface of a lifter.

Then, an upper mold of the hemming apparatus presses the bending parts toward the lower mold, to further bend the bending parts, so as to make the bending parts to closely contact with the peripheral parts of the inner panel.

In accordance therewith, the outer panel and the inner panel are integrated.

However, because the marriage process and the hemming process are performed in separate equipment in the above-described method, it is necessary to provide a carrier device that carries the outer panel and the inner panel superimposed in the marriage process to the hemming apparatus, which brings about the problem that the cost of equipment is increased and the cycle time gets longer.

SUMMARY OF THE INVENTION

One or more embodiments of the present invention provide a panel integrating method capable of reducing a cost of equipment and shortening a cycle time.

In accordance with one or more embodiments of the invention, a panel integrating method for superimposing an outer panel (for example, an outer panel 21 which will be described later) and an inner panel (for example, an inner panel 22 which will be described later) onto each other so as to integrate those with peripheral parts thereof includes processes of placing the peripheral parts of the outer panel on a top surface of a lower mold (for example, a lower mold 11 which will be described later) such that bending parts (for example, bending parts 211 which will be described later) formed by bending the peripheral parts of the outer panel are set up upward, and placing a central portion of the outer panel on a top surface of a lifting device (for example, a lifter 12 which will be described later), lifting the central portion of the outer panel by the lifting device to open leading end sides of the bending parts of the outer panel outward, placing the inner panel on the top surface of the outer panel so as to superimpose those onto each other, lowering the central portion of the outer panel by the lifting device, and pressing the bending parts toward the lower mold by an upper mold (for example, an upper mold 13 which will be described later) to further bend the bending parts, and making the bending parts to closely contact with the peripheral parts of the inner panel.

According to the method of the one or more embodiments of the invention, the outer panel and the inner panel are integrated by the following procedure. First, the outer panel having bending parts formed on its peripheral parts is prepared, and the peripheral parts of the outer panel are placed on the top surface of the lower mold such that the bending parts of the outer panel are set up upward, and the central portion of the outer panel is placed on the top surface of a lifting device.

Next, the central portion of the outer panel is lifted by the lifting device. Thereby, the peripheral parts of the outer panel are separated from the lower mold, to bow by its own weight of the outer panel, which makes the leading end sides of the bending parts open outward.

Next, the inner panel is placed to be superimposed on the top surface of the outer panel in a state in which the leading end sides of the bending parts open outward.

Next, after the inner panel is superimposed on the top surface of the outer panel, the central portion of the outer panels is lowered by the lifting device. Thereby, the peripheral parts of the outer panel are placed on the top surface of the lower mold, to cancel the state in which the peripheral parts bow. Therefore, the leading end sides of the bending parts opening outward close inward.

Next, the upper mold presses the bending parts toward the lower mold, to further bend the bending parts, which makes the bending parts to closely contact with the peripheral parts of the inner panel.

Thereby, the outer panel and the inner panel are integrated with their peripheral parts.

As described above, because the process of superimposing the outer panel and the inner panel onto each other and the process of integrating the superimposed outer panel and inner panel are performed by the same equipment, the cost of equipment can be reduced and the cycle time can be shortened.

Other aspects and advantages of the invention will be apparent from the following description, the drawings and the claims.

BRIEF DESCRIPTION OF THE DRAWINGS

FIGS. 2A to 2C are a longitudinal sectional views showing respective processes of the panel integrating method of the exemplary embodiment, in which FIG. 2A is a diagram showing a process of placing an outer panel on a lifter, FIG. 2B is a diagram showing a process of lifting the lifter to make leading end sides of bending parts open outward, and superimposing an inner panel on a top surface of the outer panel, and FIG. 2C is a diagram showing a process of lowering the lifter, and a process of making an upper mold press the bending parts onto the lower mold, to make the bending parts to closely contact with the peripheral parts of the inner panel.

DETAILED DESCRIPTION OF THE EXEMPLARY EMBODIMENTS

A panel integrating method according to an exemplary embodiment of the present invention will be described with reference to the drawings.

Figure 1:
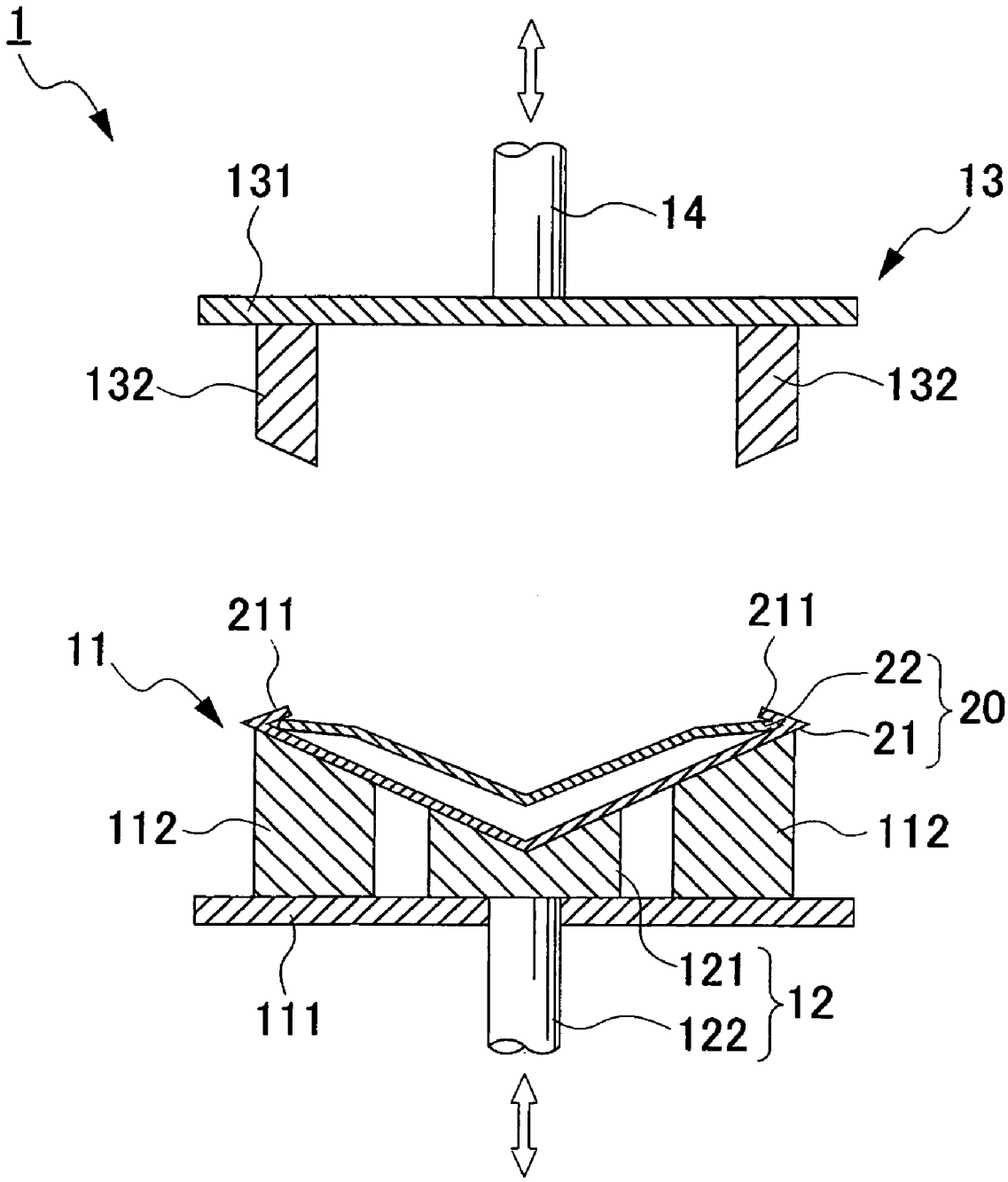
FIG. 1 is a longitudinal sectional view of a panel integrating apparatus used for a panel integrating method of an exemplary embodiment of the present invention.

FIG. 1 is a longitudinal sectional view of a panel integrating apparatus 1 used for the panel integrating method of the present invention.

The panel integrating apparatus 1 is configured to manufacture a door panel 20 by superimposing an outer panel 21 and an inner panel 22 onto each other to integrate those with their peripheral parts.

The outer panel 21 has a substantially V-shape in section whose central part projects toward the external surface side. Further, bending parts 211 are formed on the peripheral parts of the outer panel 21, and the bending parts 211 are set up toward the inner surface side of the outer panel 21.

The inner panel 22 has a substantially V-shape in section whose central part projects toward the outer panel 21. The inner panel 22 is superimposed on the inner surface side of the outer panel 21.

The door panel 20 is formed such that the bending parts 211 of the outer panel 21 are further bent to sandwich the peripheral parts of the inner panel 22, which brings the outer panel 21 and the inner panel 22 to be integrated.

The panel integrating apparatus 1 has a lifter 12 serving as a lifting device, a lower mold 11 provided so as to surround the lifter 12, an upper mold 13 provided above the lower mold 11, and an upper mold lifting mechanism 14 that lifts and lowers the upper mold 13.

The lifter 12 has lifter main body 121 on which the central portion of the outer panel 21 is placed, and a lifter lifting mechanism 122 that lifts and lowers the lifter main body 121. A control device (not shown) is connected to the lifter 12.

The surface of the metal mold of the lifter main body 121 has a substantially V-shape in section which gradually increases in height from the center toward the peripheries.

The lower mold 11 has a tabular base 111 and lower mold main bodies 112 which are set up on the top surface of the base 111 and on which the peripheral parts of the outer panel 21 are placed.

The surfaces of the metal molds of the lower mold main bodies 112 are inclined surfaces configured to gradually increase in height from the lifter 12 side toward the outer sides.

The upper mold 13 has a tabular base 131 and upper mold main bodies 132 are provided to the bottom surface of the base 131.

The upper mold main bodies 132 are disposed so as to face the lower mold main bodies 112, and the surfaces of the metal molds of the upper mold main bodies 132 are inclined surfaces configured to gradually increase in height from the lifter 12 side toward the outer sides.

The upper mold lifting mechanism 14 is interlinked to the base 131 of the upper mold 13, to make the upper mold 13 come close to or separate from the lower mold 11.

Next, a method for integrating the outer panel 21 and the inner panel 22 by using the panel integrating apparatus 1 will be described with reference to FIGS. 2A to 2C.

Figure 2A:
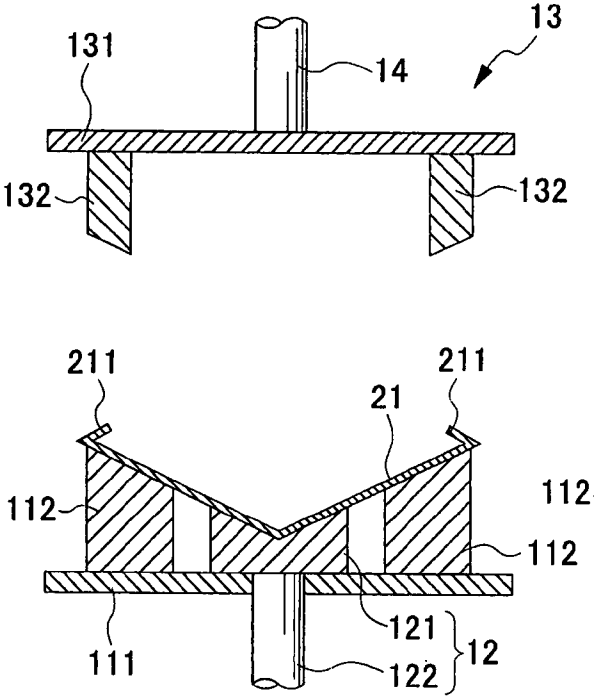
Figure 2B:
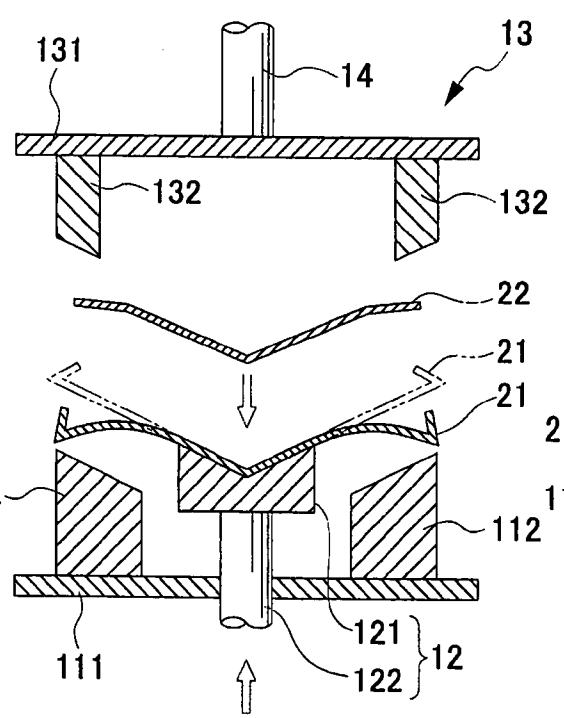
Figure 2C:
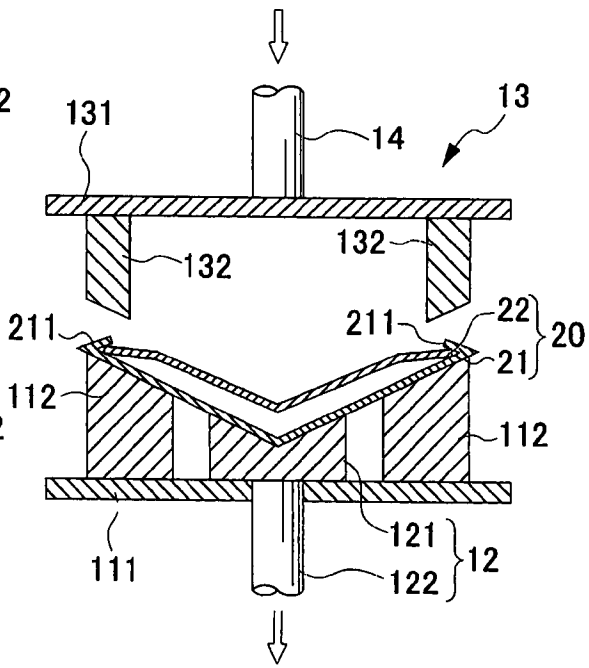

FIG. 2A is a diagram showing a process of placing the outer panel 21 on the lifter 12. FIG. 2B is a diagram showing a process of lifting the lifter 12 to make the leading end sides of the bending parts 211 open outward, and superimposing the inner panel 22 on the top surface of the outer panel 21. FIG. 2C is a diagram showing a process of lowering the lifter 12, and a process of making the upper mold 13 press the bending parts 211 onto the lower mold 11, to make the bending parts 211 to closely contact with the peripheral parts of the inner panel 22.

First, the lifter main body 121 is lowered by the lifter lifting mechanism 122, and the upper mold 13 is lifted by the upper mold lifting mechanism 14.

Next, the outer panel 21 having the bending parts 211 formed on its peripheral parts is placed on the top surfaces of the lower mold main bodies 112 and the top surface of the lifter main body 121.

The peripheral parts of the outer panel 21 are placed on the top surfaces of the lower mold main bodies 112 such that the bending parts 211 of the outer panel 21 are set up upward, and the central portion of the outer panel 21 is placed on the top surface of the lifter main body 121.

Next, the lifter main body 121 is lifted by the lifter lifting mechanism 122 to lift the central portion of the outer panel 21. Then, as shown in FIG. 2B, because the peripheral parts of the outer panel 21 are separated from the lower mold main bodies 112 to bow by its own weight of the outer panel 21, the leading end sides of the bending parts 211 open outward.

Next, the inner panel 22 is placed to be superimposed on the top surface of the outer panel 21 in a state in which the leading end sides of the bending parts 211 open outward.

Next, after the inner panel 22 is superimposed on the top surface of the outer panel 21, the lifter main body 121 is lowered by the lifter lifting mechanism 122, to lower the central portion of the outer panel 21. Then, the peripheral parts of the outer panel 21 are placed on the top surfaces of the lower mold main bodies 112, to cancel the state in which the peripheral parts bow. Therefore, the leading end sides of the bending parts 211 close inward.

Next, the upper mold 13 is lowered by the upper mold lifting mechanism 14. Then, the upper mold main bodies 132 come close to the lower mold main bodies 112 to press the bending parts 211 of the outer panel 21, and further bend the bending parts 211 to make those to closely contact with the peripheral parts of the inner panel 22.

Thereby, the superimposed outer panel 21 and inner panel 22 are integrated with their peripheral parts.

In accordance with the present embodiment, the following advantageous effects are acquired.

I. Because the process of superimposing the outer panel 21 and the inner panel 22 onto each other and the process of integrating the superimposed outer panel 21 and inner panel 22 are performed by the same equipment, the cost of equipment can be reduced, and the cycle time can be shortened.

II. The inner panel 22 is superimposed on the outer panel 21 in a state in which the leading end sides of the bending parts 211 of the outer panel 21 open outward. Therefore, when the inner panel 22 is superimposed on the top surface of the outer panel 21, the bending parts 211 do not interfere therewith, which makes it easy to superimpose the outer panel 21 and the inner panel 22 onto each other.

While description has been made in connection with specific exemplary embodiment of the invention, it will be obvious to those skilled in the art that various changes and modification may be made therein without departing from the present invention. It is aimed, therefore, to cover in the appended claim(s) all such changes and modifications falling within the true spirit and scope of the present invention.

For example, in the exemplary embodiment, the surfaces of the metal molds of the upper mold main bodies 132 are inclined surfaces corresponding to the shapes of the lower mold main bodies 112. However, the surfaces of the metal molds of the upper mold main bodies 132 are not limited thereto. That is, the upper mold main bodies may be composed of rollers, and the rollers may press the bending parts to the lower mold to make the bending parts to closely contact with the peripheral parts of the inner panel.

DESCRIPTION OF REFERENCE NUMERALS AND SIGNS

1: Panel integrating apparatus
11: Lower mold
12: Lifter (Lifting device)
13: Upper mold
21: Outer panel
22: Inner panel
211: Bending parts

What is claimed is:

1. A panel integrating method for superimposing an outer panel and an inner panel onto each other and integrating the outer panel and the inner panel with peripheral parts thereof, the method comprising:

placing the peripheral parts of the outer panel on a top surface of a lower mold such that bending parts formed by bending the peripheral parts of the outer panel are set up upward, and placing a central portion of the outer panel on a top surface of a lifting device;

lifting the central portion of the outer panel by the lifting device to open leading end sides of the bending parts of the outer panel outward;

placing the inner panel on the top surface of the outer panel so as to superimpose those onto each other;

lowering the central portion of the outer panel by the lifting device; and pressing the bending parts toward the lower mold by an upper mold to further bend the bending parts, and making the bending parts to closely contact with the peripheral parts of the inner panel.

* * * * *